US009404528B2

(12) United States Patent
Shan

(10) Patent No.: US 9,404,528 B2
(45) Date of Patent: Aug. 2, 2016

(54) LOCKING ASSEMBLY AND SUPPORTING DEVICE THEREWITH

(71) Applicant: Lin-Hai Shan, Guangdong (CN)

(72) Inventor: Lin-Hai Shan, Guangdong (CN)

(73) Assignee: Wonderland Nurseygoods Company Limited, N.T. (HK)

( * ) Notice: Subject to any disclaimer, the term of this patent is extended or adjusted under 35 U.S.C. 154(b) by 88 days.

(21) Appl. No.: 13/970,620

(22) Filed: Aug. 20, 2013

(65) Prior Publication Data

US 2014/0054938 A1 Feb. 27, 2014

(30) Foreign Application Priority Data

Aug. 22, 2012 (CN) ..... 2012 1 0301244

(51) Int. Cl.

| | |
|---|---|
| ***A47C 4/00*** | (2006.01) |
| ***F16C 11/10*** | (2006.01) |
| ***A47D 1/00*** | (2006.01) |
| ***A47D 1/02*** | (2006.01) |
| ***A47D 1/10*** | (2006.01) |

(52) U.S. Cl.

CPC ..... *F16C 11/10* (2013.01); *A47D 1/002* (2013.01); *A47D 1/02* (2013.01); *A47D 1/10* (2013.01); *Y10T 16/5409* (2015.01)

(58) Field of Classification Search

CPC ..... B60N 2/10; A47D 1/002; A47D 13/02; A47D 1/02; F16C 11/10

USPC ..... 297/326, 327, 183.2–183.4, 16.1

See application file for complete search history.

(56) References Cited

U.S. PATENT DOCUMENTS

| | | | | | |
|---|---|---|---|---|---|
| 4,410,176 | A | * | 10/1983 | Miller | 482/144 |
| 4,534,554 | A | * | 8/1985 | Miller | 482/144 |
| 5,028,061 | A | * | 7/1991 | Hawkes | 280/47.4 |
| 5,143,419 | A | * | 9/1992 | Tepper et al. | 297/183.3 |
| 5,364,137 | A | * | 11/1994 | Shimer | 297/327 |
| 5,961,180 | A | * | 10/1999 | Greger et al. | 297/183.4 |
| 6,089,653 | A | * | 7/2000 | Hotaling et al. | 297/130 |
| 6,145,927 | A | * | 11/2000 | Lo | 297/250.1 |
| 6,170,910 | B1 | * | 1/2001 | Bapst | 297/184.13 |
| 6,347,830 | B1 | * | 2/2002 | Chen | 297/16.1 |
| 6,398,304 | B1 | * | 6/2002 | Chen et al. | 297/327 |
| 6,443,522 | B1 | * | 9/2002 | Kain et al. | 297/184.17 |
| 6,682,137 | B2 | * | 1/2004 | Hsia | 297/32 |
| 6,715,828 | B1 | * | 4/2004 | Cheng | 297/183.3 |

(Continued)

FOREIGN PATENT DOCUMENTS

| | | |
|---|---|---|
| CN | 1122295 A | 5/1996 |
| DE | 203 10 316 U1 | 9/2003 |

(Continued)

*Primary Examiner* — David E Allred
*Assistant Examiner* — Alexander Harrison
(74) *Attorney, Agent, or Firm* — Winston Hsu; Scott Margo

(57) ABSTRACT

The present invention is to provide a locking assembly including a joint device and a safety lock mechanism. The joint device includes a first joint component, a second joint component and a button assembly. The second joint component is pivoted to the first joint component. The button assembly is slidably disposed between the first joint component and the second joint component, and the button assembly is for locking a pivotal movement of the first joint component and the second joint component. The safety lock mechanism movably passes through the second joint component to selectively engage with the button assembly, so as to lock the button assembly selectively. Therefore, it increases the operating safety.

22 Claims, 15 Drawing Sheets

(56) References Cited

U.S. PATENT DOCUMENTS

| | | | | |
|---|---|---|---|---|
| 6,893,040 | B2 * | 5/2005 | Hou et al. | 280/642 |
| 6,951,371 | B2 | 10/2005 | Wang | |
| 7,568,758 | B2 * | 8/2009 | Troutman et al. | 297/148 |
| 8,157,327 | B2 * | 4/2012 | Tomasi | 297/344.14 |
| 8,205,943 | B2 * | 6/2012 | Zhong | 297/274 |
| 8,668,273 | B2 * | 3/2014 | Wang | 297/467 |
| 2003/0164627 | A1 * | 9/2003 | Sedlack | 297/183.1 |
| 2007/0246976 | A1 * | 10/2007 | Jane Santamaria | 297/183.3 |
| 2008/0303232 | A1 * | 12/2008 | Chen et al. | 280/47.41 |
| 2010/0117424 | A1 * | 5/2010 | Lin | 297/327 |
| 2012/0104808 | A1 * | 5/2012 | Sellers et al. | 297/183.4 |
| 2013/0009428 | A1 * | 1/2013 | Heisey | 297/183.2 |

FOREIGN PATENT DOCUMENTS

| | | | |
|---|---|---|---|
| EP | 1 702 537 | A1 | 9/2006 |
| EP | 2 505 105 | A1 | 10/2012 |

* cited by examiner

LOCKING ASSEMBLY AND SUPPORTING DEVICE THEREWITH

BACKGROUND OF THE INVENTION

1. Field of the Invention

The present invention relates to a locking assembly and a supporting device therewith, and more specifically, to a locking assembly with easy operation and capable of preventing a frame from being folded accidentally and a supporting device therewith.

2. Description of the Prior Art

It is a common way for parents to use an infant seat to carry a baby. For now, there are various infant seats in the market, such as an infant carrier, an infant car seat, and so on. The infant seats are practical for being carried or being installed inside a car. For example, the baby basket solves a problem that the parents must hold the baby by hands and cannot put the baby down when the parents go outside and feel tired. The infant car seat solves a problem that the baby is too small to be fastened by vehicle belt or other fixing band, and the infant car seat provides the parents with great convenience when the parents go outside.

As the infant seats are widely used gradually, people request more convenience in operation of the infant seat. The infant seats described above have to be disposed on the stroller or a specific supporting frame. However, for cooperating with various infant seats in the market, the connection between the infant seat with the stroller or the supporting frame is usually designed to be a detachable structure. In addition, in order to facilitate the parents to carry or store the stroller or the supporting frame, the stroller or the supporting frame is usually designed to be able to be folded. Accompanying with multi-functions of the infant seat, a safety requirement is also an important issue of the infant seat. However, the foldable stroller or the supporting frame may be folded accidentally as the infant seat is coupled thereon. Therefore, it is necessary to provide a structure which is operated easily and can prevent the stroller or the supporting frame from being folded accidentally, to solve the above problems.

SUMMARY OF THE INVENTION

A purpose of the present invention is to provide a locking assembly with a safety lock mechanism, so as to facilitate a supporting device to be operated easily, and to prevent the supporting device from being folded accidentally, to enhance operating safety.

In order to achieve the above purpose, the present invention provides a locking assembly including a joint device and a safety lock mechanism. The joint device includes a first joint component, a second joint component and a button assembly. The second joint component is pivoted to the first joint component. The button assembly is slidably disposed between the first joint component and the second joint component, and the button assembly is for locking a pivotal movement between the first joint component and the second joint component. The safety lock mechanism movably passes through the second joint component to selectively engage with or separated from the button assembly, so as to lock or release movement of the button assembly selectively.

Preferably, an installing slot is formed on the second joint component, and the safety lock mechanism is movably disposed on the installing slot.

Preferably, a hole is formed on the second joint component, and the safety lock mechanism movably passes through the hole.

Preferably, a moving direction of the safety lock mechanism is intersected with a pivotal plane formed by the first joint component and the second joint component.

Preferably, the moving direction of the safety lock mechanism is perpendicular to the pivotal plane.

Preferably, a moving direction of the safety lock mechanism is intersected with a sliding plane formed by the button assembly.

Preferably, the moving direction of the safety lock mechanism is perpendicular to the sliding plane.

Preferably, the safety lock mechanism includes a locking block movably passing through the second joint component.

Preferably, the safety lock mechanism further includes a resilient component disposed between the locking block and the second joint component.

Preferably, the locking block includes a base portion, a contacting portion, a pushing portion and an engaging portion. The contacting portion is formed on a side of the base portion, and the resilient component is disposed between the contacting portion and the second joint component. The pushing portion is formed on the other side of the base portion, and the pushing portion is for movably passing through the second joint component. The engaging portion is formed on the pushing portion, the engaging portion being for detachably engaging with the button assembly.

Preferably, a portion of the locking block exposed outside the second joint component comprises an inclined surface or a curved surface.

Preferably, a locking slot is formed on the button assembly and for engaging with the locking block.

Preferably, the locking block and the locking slot are engaged by a mortise joint.

Preferably, a supporting device for supporting an infant seat, comprising a supporting frame, a joint device disposed on one sides of the supporting frame, and a safety lock mechanism. The joint device includes a first joint component, a second joint component pivoted to the first joint component, and a button assembly movable disposed between the first joint component and the second joint component. The safety lock mechanism is movably disposed on the second joint component to selectively engage with the button assembly, so as to prevent button assembly from moving.

Preferably, the button assembly includes a sliding block slidably disposed on the first joint component.

Preferably, the sliding block comprises a protruding block to engage with the second joint when the supporting device is at an extended state.

Preferably, the supporting frame includes two first supporting frames and two second supporting frames, the supporting device includes two joints device, and the two joint devices are disposed between the two first supporting frames and the two second supporting frames respectively.

Preferably, a combination includes an infant seat and a support device for detachably coupling with the infant seat. The supporting device includes a supporting frame, a joint device and a safety lock mechanism. The supporting frame is movable between an extended state and a folded state. The joint device is disposed on the supporting frame comprising a button assembly for locking the joint device so as to retain the support frame being at the extended state. The safety lock mechanism is movably disposed on joint device, wherein the joint device includes a coupling portion to allow the infant seat to engage thereon, when the infant seat is coupling with the joint device, the infant seat presses the safety lock mechanism to engage with the assembly.

Preferably, a combination includes an infant seat and a support device for detachably coupling with the infant seat.

The supporting device includes a supporting frame, a joint device and a safety lock mechanism. The supporting frame is movable between an extended state and a folded state. The joint device is disposed on the supporting frame and includes a first joint component, a second joint component pivoted to the first joint component and a button assembly disposed between the first joint component and the second joint component. The button assembly is movable between a locking position when the first joint component and the second joint component is locked and a released position when the first joint component and the second joint component are free to move relative to each other. The safety lock mechanism is movably disposed the second joint and includes a locking block retractably disposed on the second joint component, wherein when button assembly is at the released position, the first joint component and the second joint component are pivoted relative to each other, and the button assembly is abutted against the locking block so that the locking block cannot retract into the second joint component, so as to prevent the infant seat from coupling with the supporting device.

In contrast to the prior art, the safety lock mechanism of the present invention can movably passes through the second joint component to engage with or detached from the button assembly, so as to lock or release the button assembly. Therefore, only when the supporting device is unfolded completely, the infant seat is able to install on the joint device, so as to prevent the supporting device from being folded accidentally in a procedure of installing the infant seat on the supporting device. In addition, as the supporting device is not unfolded completely, the infant seat is not able to install on the joint device, so as to increase the operating safety and to prevent an error operation of installation. After detaching the infant seat from the supporting device, the locking block is separated from the button assembly, so that the button assembly is released and the supporting device is able to be folded, so as to ensure the safety of operating the infant seat.

These and other objectives of the present invention will no doubt become obvious to those of ordinary skill in the art after reading the following detailed description of the preferred embodiment that is illustrated in the various figures and drawings.

DETAILED DESCRIPTION

An embodiment of the present invention is described with figures, and similar labels represent similar components. In the following detailed description of the preferred embodiments, reference is made to the accompanying drawings which form a part hereof, and in which is shown by way of illustration specific embodiments in which the invention maybe practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
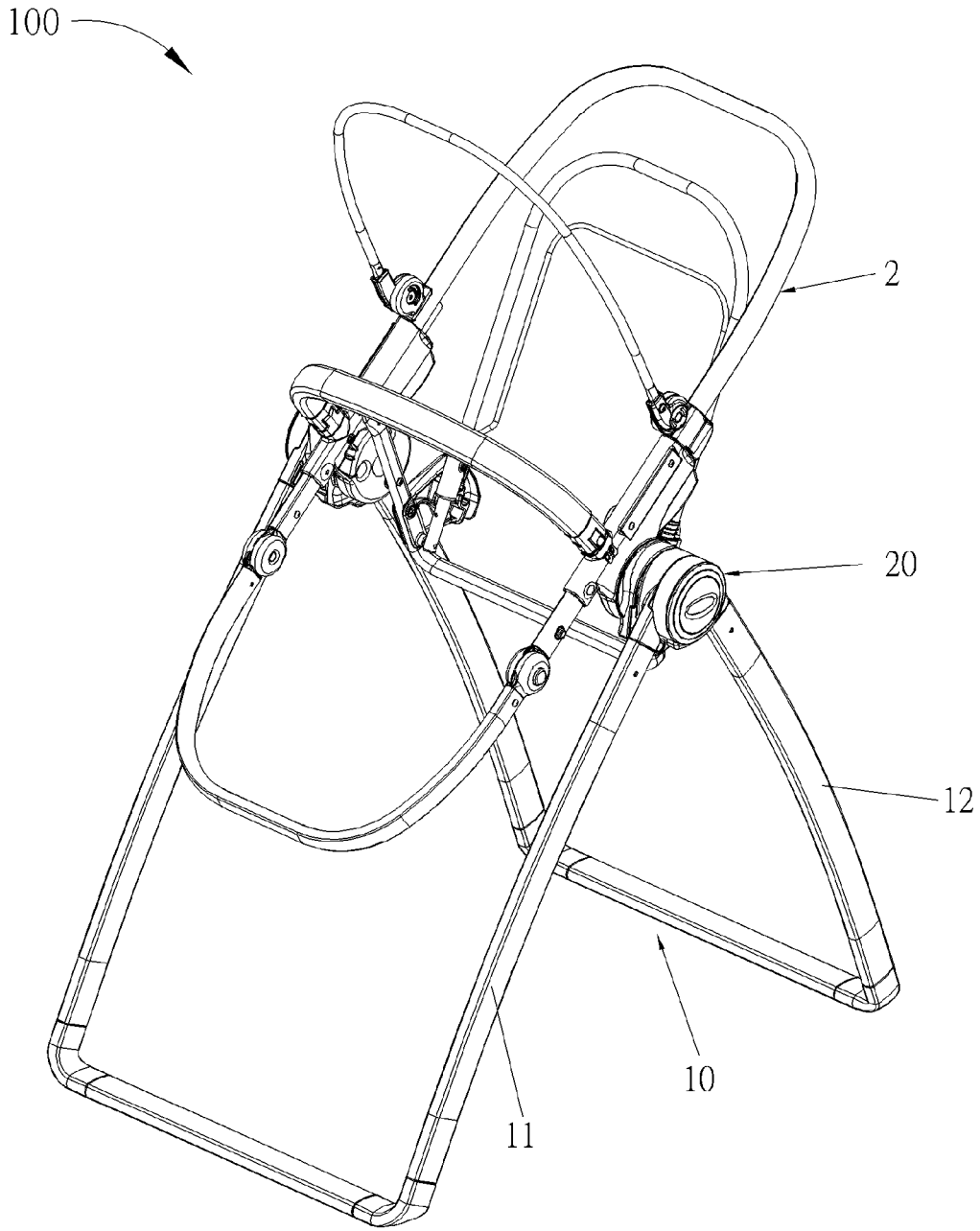
FIG. 1 is an assembly diagram of a supporting device and an infant seat according to an embodiment of the present invention.
Figure 2:
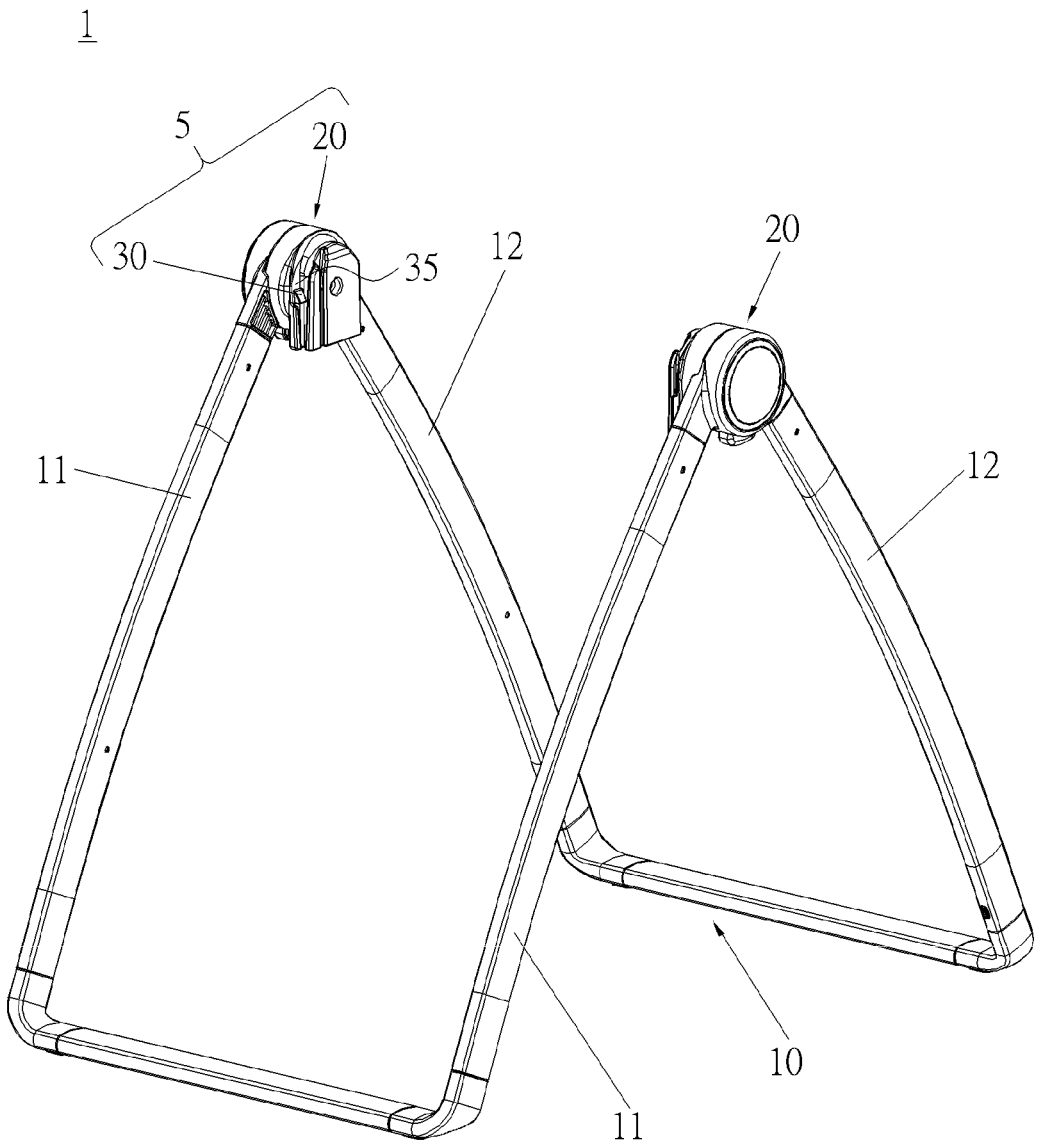
FIG. 2 is a schematic diagram of the supporting device according to the embodiment of the present invention.

Please refer to FIG. 1 and FIG. 2. FIG. 1 is an assembly diagram of a supporting device 1 and an infant seat 2 according to an embodiment of the present invention. FIG. 2 is a schematic diagram of the supporting device 1 according to the embodiment of the present invention. The present invention provides a combination 100 including the infant seat 2 and the supporting device 1 for detachably coupling with and supporting the infant seat 2. The infant seat 2 can be an infant carrier, an infant car seat or other infant seats.

As shown in FIG. 1 and FIG. 2, the supporting device 1 includes a supporting frame 10 and two locking assemblies 5. The supporting frame 10 includes two first supporting frames 11 and two second supporting frames 12. The supporting frame 10 of the supporting device 1 is movable between an extended state and a folded state. Each locking assembly 5 includes a joint device 20 and a safety lock mechanism 30 connected to the joint device 20. Two joint devices 20 are disposed on two sides of the supporting frame 10, and the infant seat 2 can be detachably engaged with the two joint devices 20. Two safety lock mechanisms 30 are disposed on the two joint devices 20 symmetrically. In this embodiment, each joint device 20 is connected to the corresponding first supporting frame 11 and the corresponding second supporting frame 12. The two first supporting frames 11 and the two second supporting frames 12 can move forward and backward respectively, so that the supporting device 1 can be extended to support the infant seat 2. In addition, the two first supporting frames 11 can pivot relative to the two second supporting frames 12 via the joint device 20, so as to fold the supporting device 1.

The two joint devices 20 and the two safety lock mechanisms 30 are disposed on the supporting device 1 symmetrically. Hence, the joint device 20 and the safety lock mechanism 30 on one side of the supporting frame 10 are described as follows in detail.

Figure 3:
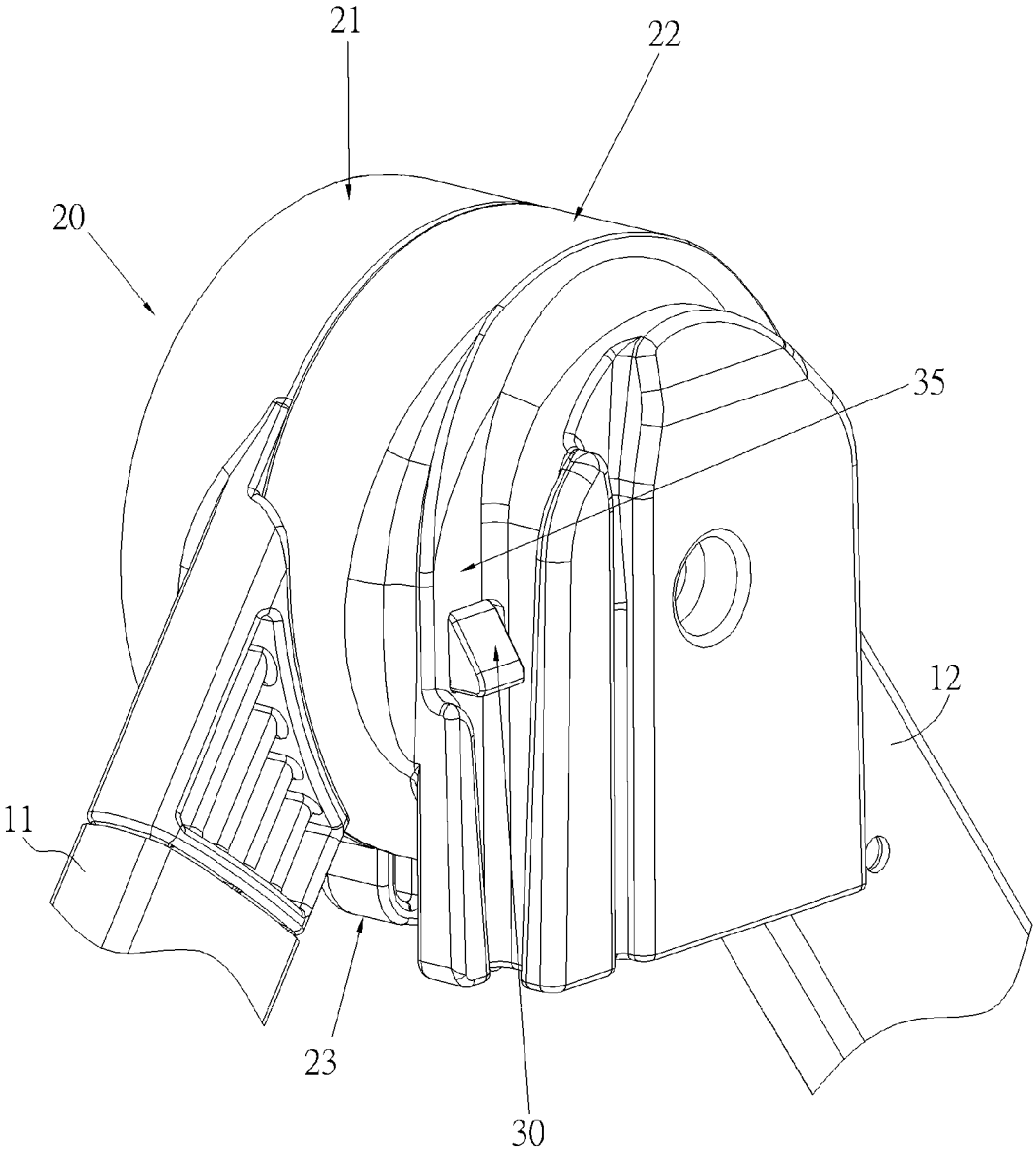
FIG. 3 is a diagram of a joint device on a left side of a supporting frame according to the embodiment of the present invention.
Figure 4:
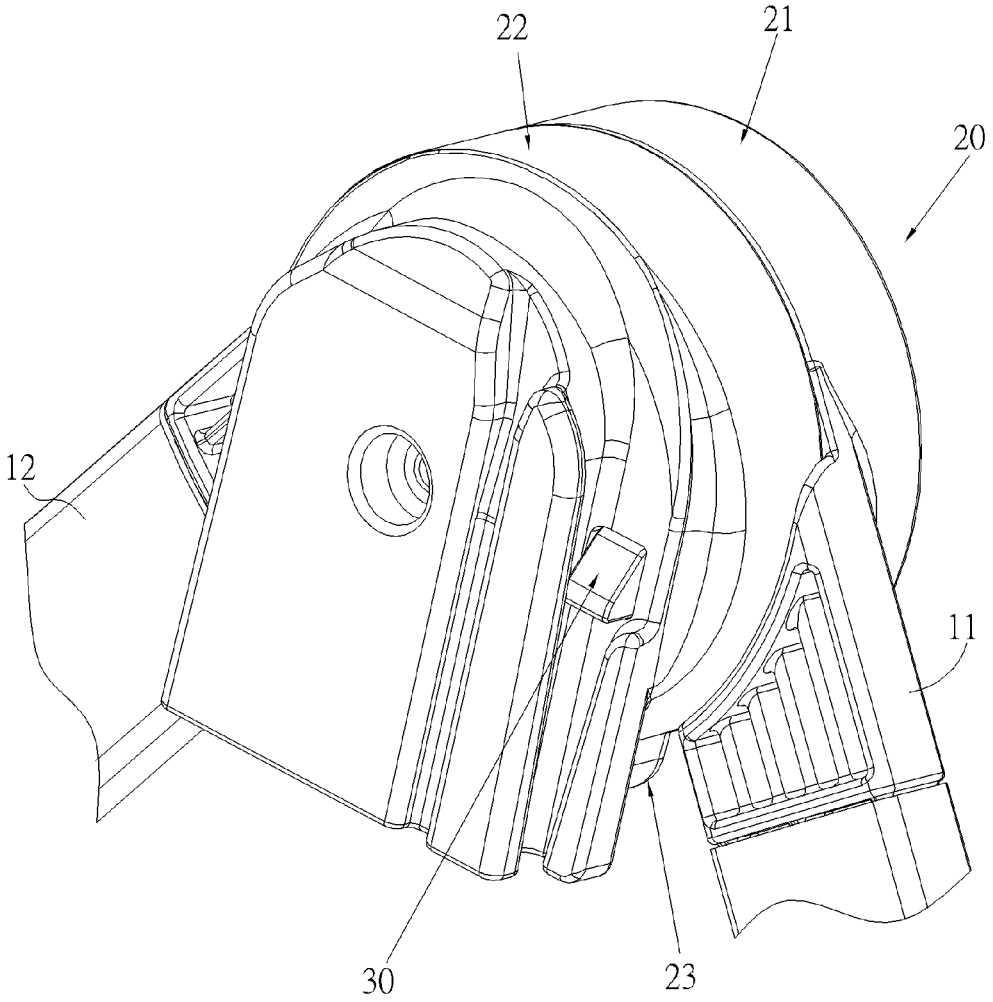
FIG. 4 is a diagram of a joint device on a right side of the supporting frame according to the embodiment of the present invention.
Figure 5:
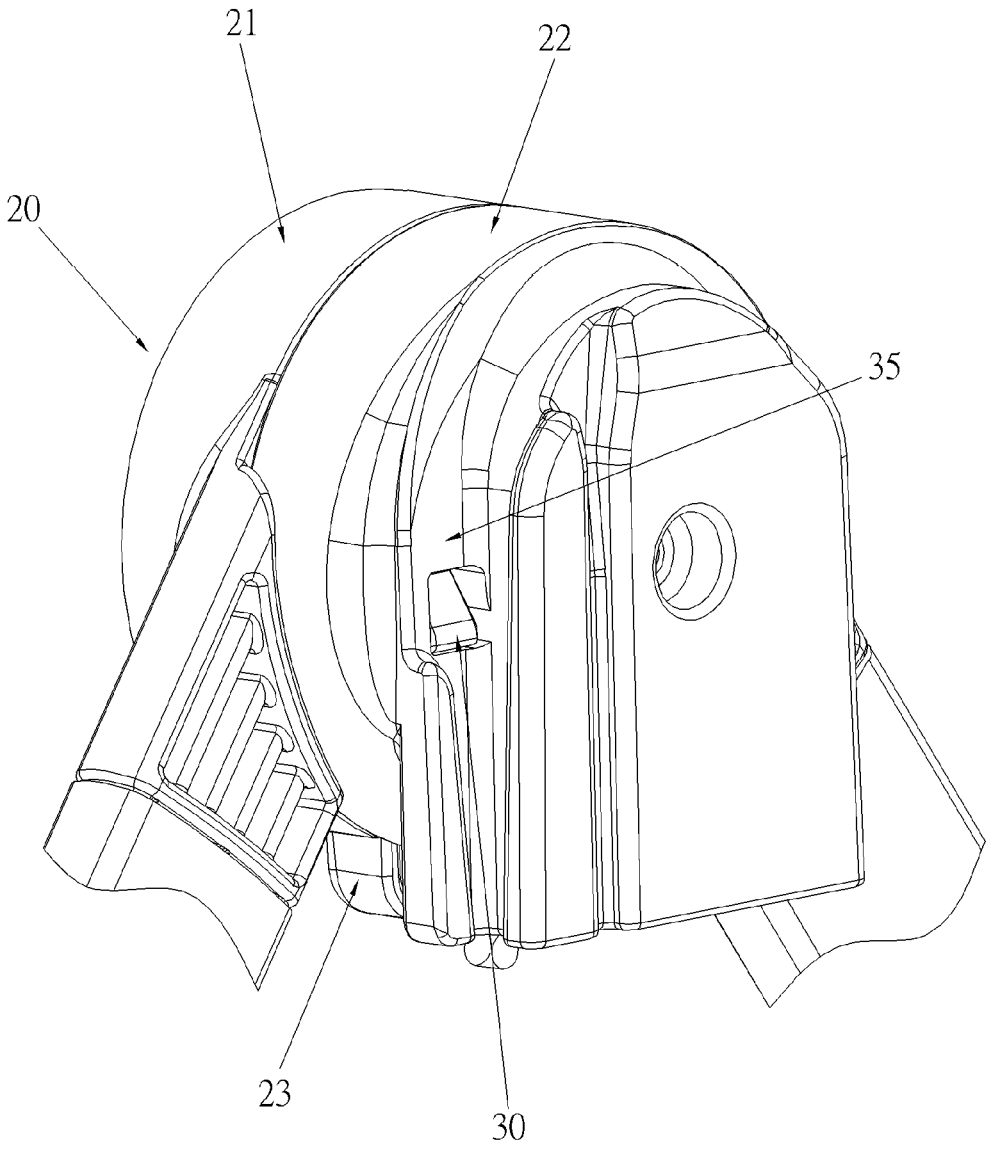
FIG. 5 is a diagram illustrating that a safety lock mechanism is pushed inside the joint device according to the embodiment of the present invention.

Please refer to FIG. 3 to FIG. 5. FIG. 3 is a diagram of the joint device 20 on a left side of the supporting frame 10 according to the embodiment of the present invention. FIG. 4 is a diagram of the joint device 20 on a right side of the supporting frame 10 according to the embodiment of the present invention. FIG. 5 is a diagram illustrating that the safety lock mechanism 30 is pushed inside the joint device 20 according to the embodiment of the present invention. The joint device 20 includes a first joint component 21, a second joint component 22 and a button assembly 23. The first joint component 21 and the second joint component 22 are pivoted on each other. The first joint component 21 and the second joint component 22 are connected to the first supporting frame 11 and the second supporting frame 12 respectively. In this embodiment, an outer side of the second joint component 22 included a coupling portion 35 to allow the infant seat 2 to engage thereon. The button assembly 23 is disposed between the first joint component 21 and the second joint component 22, and the button assembly 23 is for locking or releasing a pivotal movement of the first joint component 21 and the second joint component 22. That is, the button assembly 23 is for locking or releasing the joint device 20. The safety lock mechanism 30 is disposed on the second joint component 22 and movably passes through the corresponding second joint component 22 to detachably engage with the corresponding button assembly 23, so as to lock the corresponding button assembly 23. That is, the safety lock mechanism 30 can be selectively engaged with or detached from the button assembly 23. As the safety lock mechanism 30 is not engaged with the button assembly 23, a portion of the safety lock mechanism 30 protrudes outside the second joint component 22.

Figure 6:
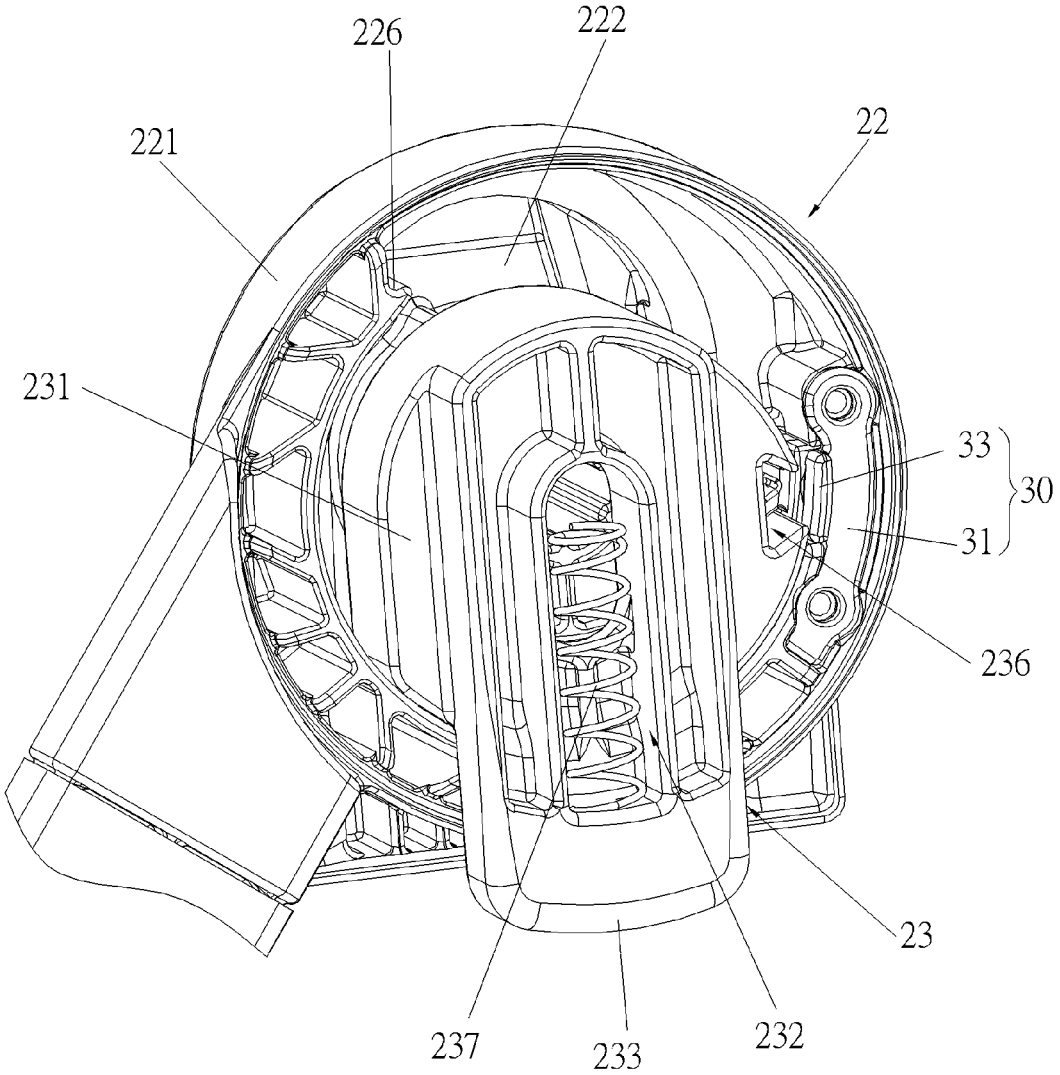
FIG. 6 to FIG. 8 are partial diagrams of the safety lock mechanism and the joint device in different views according to the embodiment of the present invention.
Figure 7:
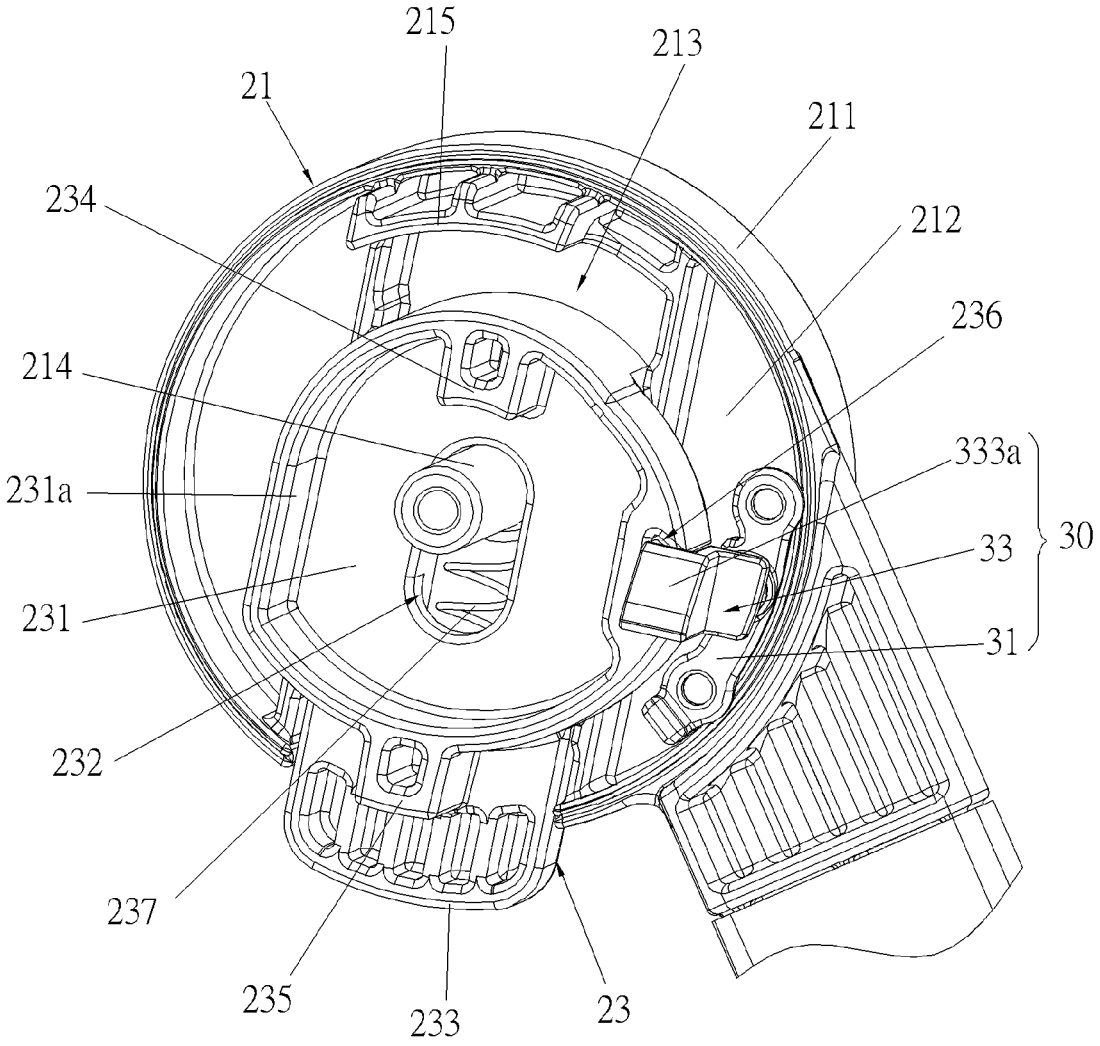
Figure 8:
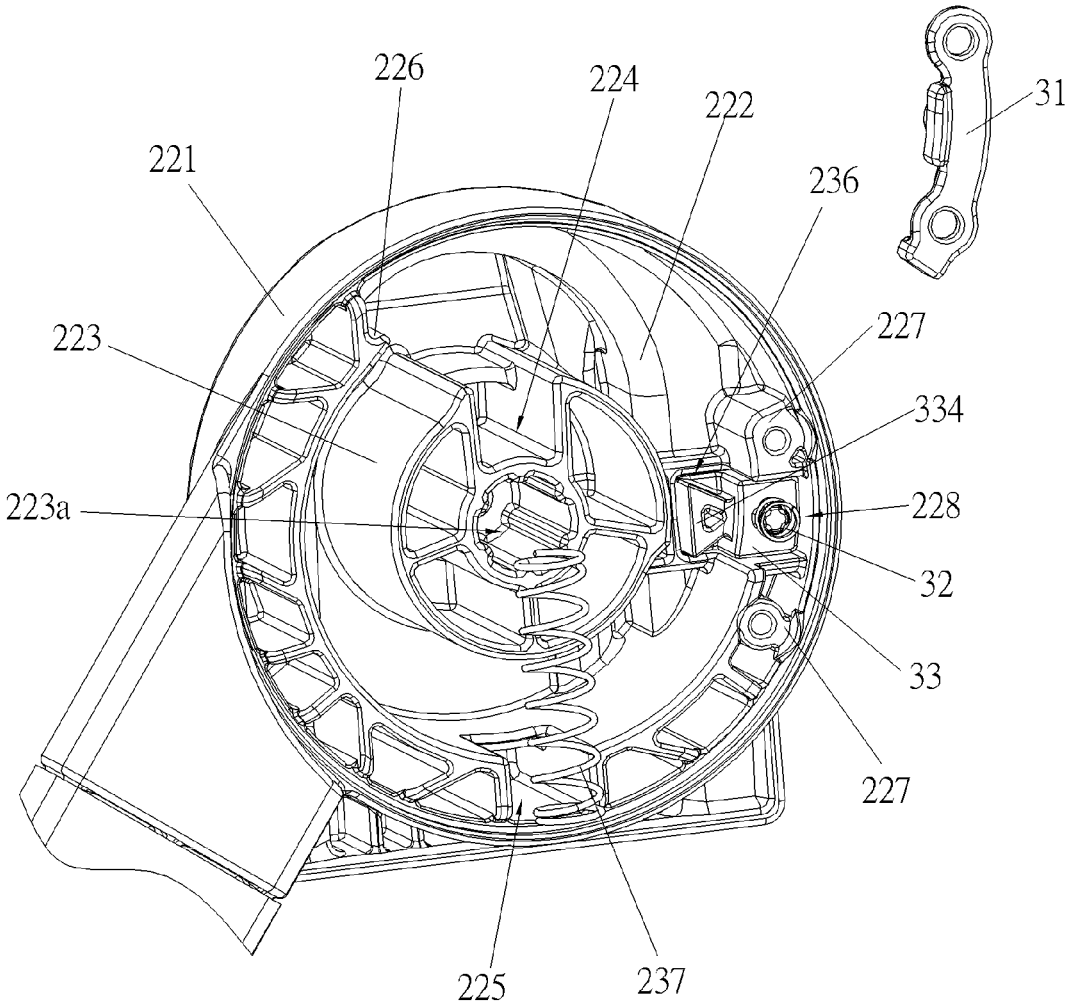
Figure 9:
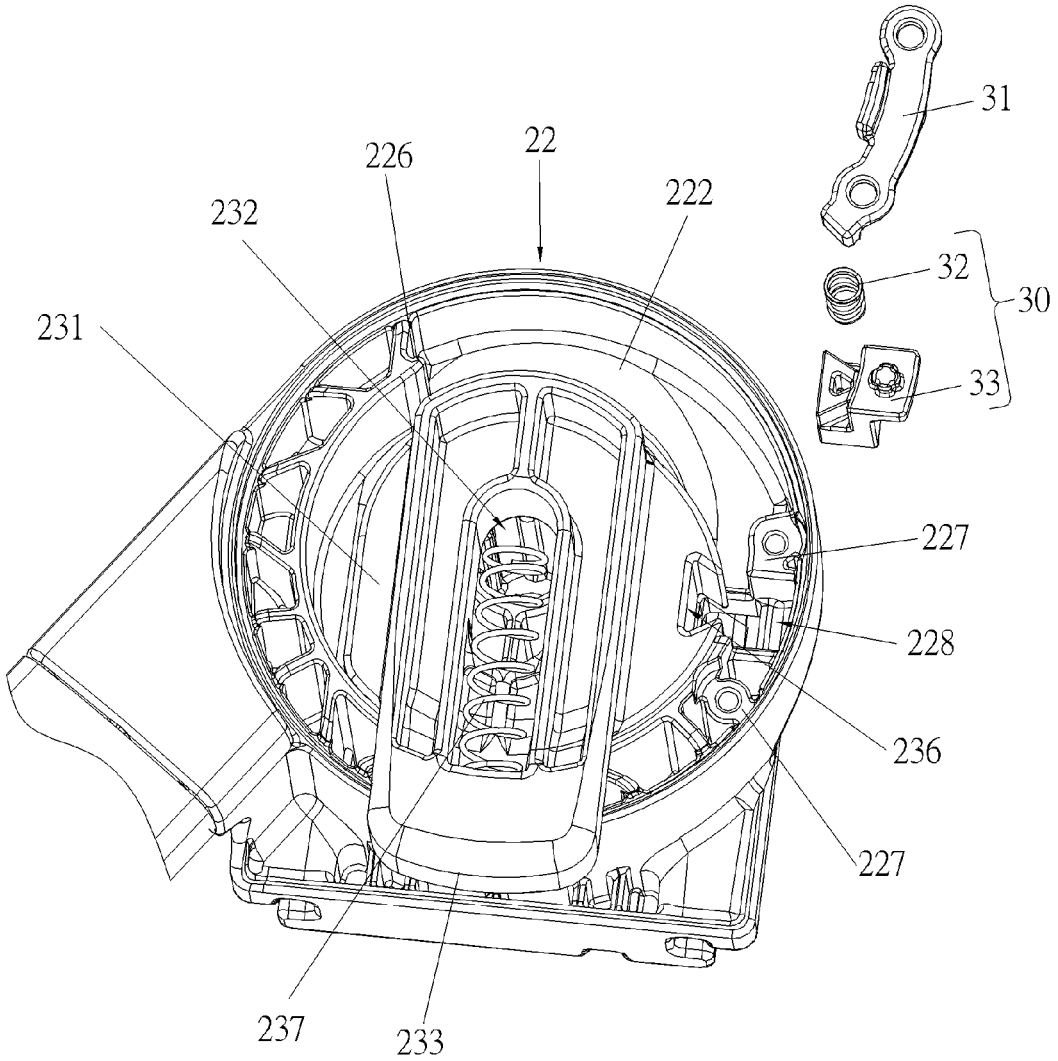
FIG. 9 is an exploded diagram of the second joint component and the safety lock mechanism according to the embodiment of the present invention.

Please refer to FIG. 3 to FIG. 9. FIG. 6 to FIG. 8 are partial diagrams of the safety lock mechanism 30 and the joint device 20 in different views according to the embodiment of the present invention. FIG. 9 is an exploded diagram of the second joint component 22 and the safety lock mechanism 30 according to the embodiment of the present invention. Refer to FIG. 7, the first joint component 21 includes a first wall 211, a first base 212, a guiding way 213, a shaft 214 and a block 215. The first wall 211 is connected to a peripheral of the first base 212 upright. The guiding way 213 is formed on an inner surface of the first base 212, and the shaft 214 protrudes from the first base 212 and positioned and passes through the guiding way 213. An opening is formed on a lower end of the first base 212 where corresponds to the guiding way 213 and is space communicated with the guiding way 213. The block 215 is formed on an upper end of the first base 212 where corresponds to the guiding way 213. The shaft 214 is pivotally connected the second joint component 22, and the button assembly 23 is slidably installed on the guiding way 213 so as to movably connect to the first base 212 of the first joint component 21.

Correspondingly, Refer to FIG. 6, 8 and 9, the second joint component 22 includes a second wall 221, a second base 222 and a column 223. The second wall 221 is connected to a peripheral of the second base 222 upright, and the second wall 221 is coupled with the first wall 211. The button assembly 23 is movably connected to the first base 212 and is selectively engaged with or detached from the column 223. Specifically, the column 223 is disposed on an inner surface of the second base 222, and a pivoting hole **223*a* corresponding to the shaft 214 is formed on the column 223. The shaft 214 is pivoted to the pivoting hole 223*a*, so that the first joint component 21 can be pivoted on the second joint component 22. In addition, two fixing portions 227 are disposed on the inner surface of the second base 222 separately, and an installing slot 228 is formed on the second joint component 22 and between the two fixing portions 227. The safety lock mechanism 30 is movably installed inside the installing slot 228, and the portion of the safety lock mechanism 30 protrudes outside the second joint component 22**.

As shown in FIG. 6 to FIG. 8, the button assembly 23 includes a sliding block 231 and a recovering component 237. A side wall **231*a* is formed on a side of the sliding block 231, and the side wall 231*a* is a ring-shaped structure. A sliding slot 232 with a long shape is formed on the sliding block 231. A pressing portion 233 is extended from a low end of the sliding block 231. A first protruding block 234 is extended from inner side of an upper end of the side wall 231*a* downwardly, and a second protruding block 235 is extended from inner side of a lower end of the side wall 231*a* downwardly. The sliding block 231 is slidably disposed on the guiding way 213 of the first joint component 21, and the shaft 214 passes through the sliding slot 232. The recovering component 237 is disposed inside the sliding slot 232 and two ends of the recovering component 237 abut against the shaft 214 and the pressing portion 233. The pressing portion 233 passes through the opening to expose outside the first joint component 21. The first protruding block 234 is detachably engaged with the column 223. The sliding block 231 is slidably along the guiding way 213 and is not interfered by other objects, so that the sliding block 231 is protected and can move stably. User is allowed to press the pressing portion from outside of the first joint component 21 and the second joint component 22, so as to drive the sliding block 231 to move, and the first protruding block 234 is disengaged from the column 223. The pressing portion 233** is designed to be operated more easily.

An engaging slot 224 corresponding to the first protruding block 234 of the button assembly 23 is formed on a side wall of the column 223. A concave 225 is formed on an inner wall of the second wall 221, and the engaging slot 224 and the concave 225 are aligned on a straight line. The concave 225 corresponds to the second protruding block 235 of the button assembly 23. Therefore, the first protruding block 234 is selectively engaged with or detached from the engaging slot 224, and the second protruding block 235 is selectively engaged with or detached from the concave 225. As the first protruding block 234 is engaged with the engaging slot 224 and the second protruding block 235 is engaged with the concave 225, the two first supporting frames 11 and the two second supporting frames 12 are away from each other, so that the supporting device 1 is in an extended state.

Furthermore, a limiting slot 226 is formed on the second wall 221, and the block 215 on an inner surface of the first wall 211 is slidably coupled to the limiting slot 226. The angle of pivotal movement of the first joint component 21 and the second joint component 22 is constrained by the cooperation between the block 215 and the limiting slot 226. For example, as the first joint component 21 pivots relative to the second joint component 22 and the two first supporting frames 11 and the two second supporting frames 12 move close to each other or move away from each other, the cooperation between the block 215 and the limiting slot 226 can prevent the two first supporting frames 11 and the two second supporting frames 12 from being too close to each other or too far away from each other.

Figure 10:
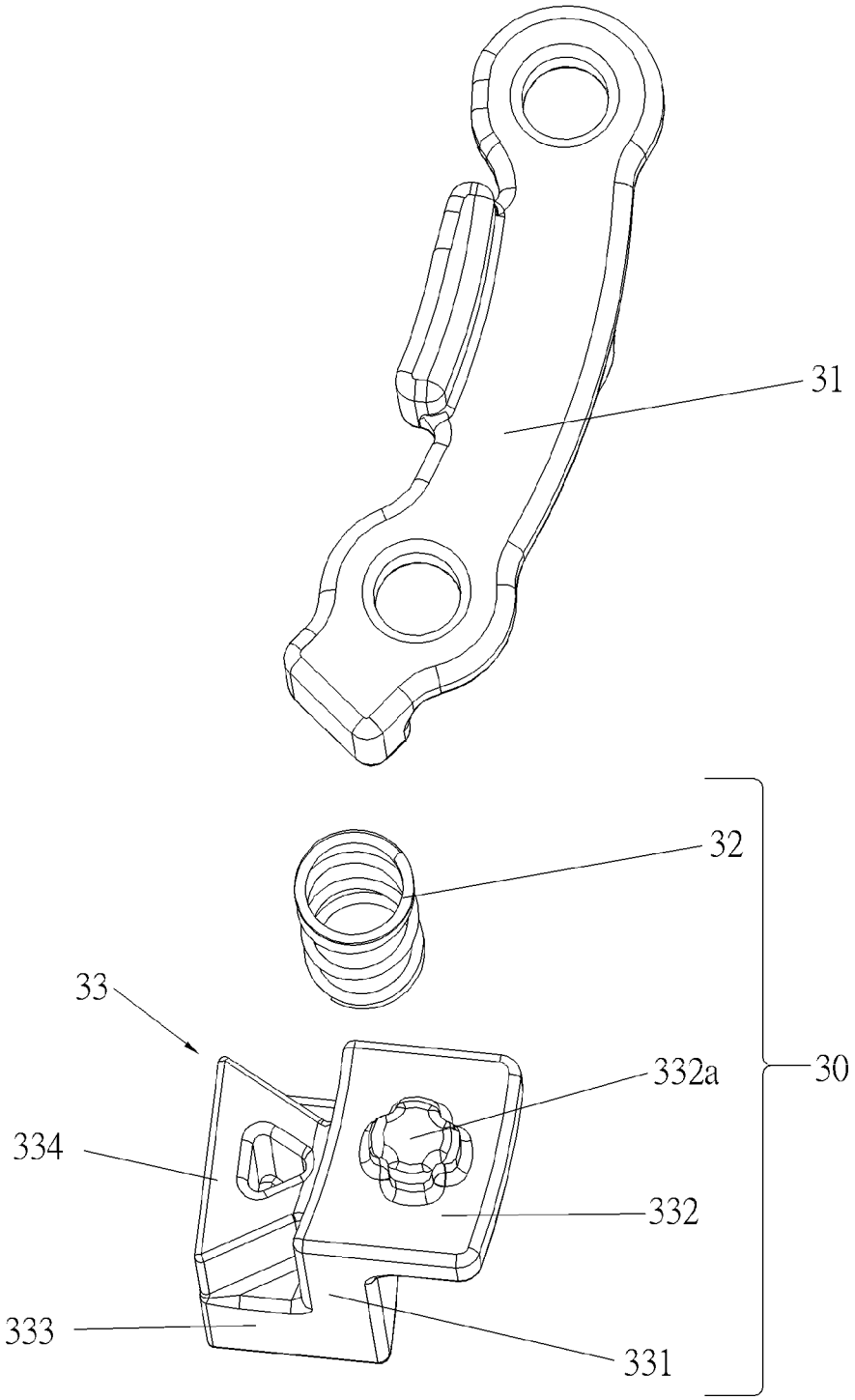
FIG. 10 is an exploded diagram of the safety lock mechanism according to the embodiment of the present invention.
Figure 11:
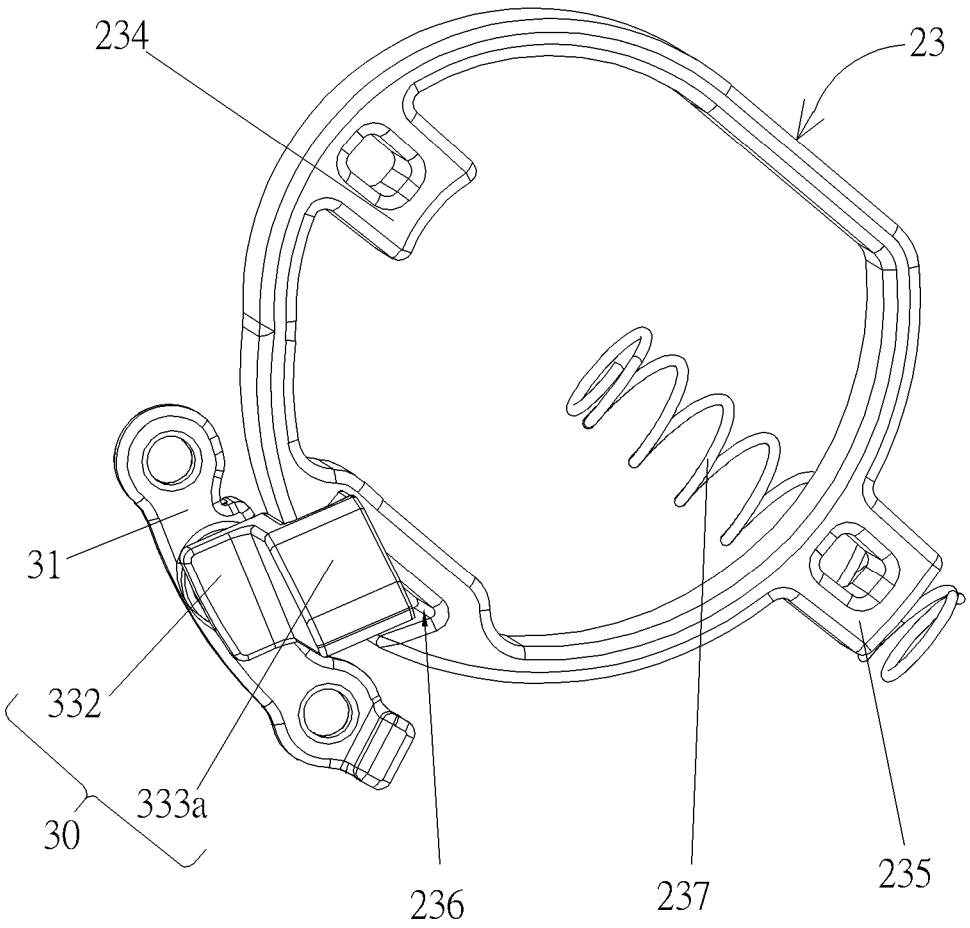
FIG. 11 is an assembly diagram of the safety lock mechanism and a button assembly according to the embodiment of the present invention.

Please refer to FIG. 6 to FIG. 11. FIG. 10 is an exploded diagram of the safety lock mechanism 30 according to the embodiment of the present invention. FIG. 11 is an assembly diagram of the safety lock mechanism 30 and the button assembly 23 according to the embodiment of the present invention. The second joint component 22 includes a strip block 31, and the safety lock mechanism 30 includes a resilient component 32 and a locking block 33. The locking block 33 movably passes through a hole of the second joint component 22. That is, the locking block 33 is movably disposed on the installing slot 228, and a portion of the locking block 33 of the safety lock mechanism 30 protrudes outside the second joint component 22. The locking block 33 is detachably engaged with the button assembly 23 . The strip block 31 is disposed on the inner surface of the second joint component 22 and fixed on the two fixing portions 227. Two ends of resilient component 32 are abutted against the locking block 33 and the strip block 31 of the second joint component 22. Therefore, the locking block 33 is biased by the resilient component 32 to protrude outside the second joint component 22. A moving direction of the locking block 33 of the safety lock mechanism 30 is intersected with a pivotal plane formed by the first joint component 21 and the second joint component 22. Preferably, the moving direction of the locking block 33 of the safety lock mechanism 30 is perpendicular to the pivotal plane.

As shown in FIG. 8 and FIG. 9, the two fixing portions 227 are disposed on the inner surface of the second base 222. Specifically, the two fixing portions 227 are disposed on a side of the straight line where the engaging slot 224 and the concave 225 are located on. The installing slot 228 is formed between the two fixing portions 227, and the hole communicated with the installing slot 228 is formed on the second base 222 of the second joint component 22. The hole penetrates through the second joint component 22, and the safety lock mechanism 30 movably passes through the hole. The locking block 33 is movably disposed on the installing slot 228, and an end of the locking block 33 passes through the hole and protrudes outside the second joint component 22. The end of the locking block 33 is positioned on area of the coupling portion 35 of the second joint component 22 after passing through thereon. An end of the resilient component 32 contacts against the other end of the locking block 33, and the other end of the resilient component 32 contacts against the strip block 31. Two ends of the strip block 31 are fixed on the two fixing portions 227 respectively.

As shown in FIG. 8 to FIG. 11, the locking block 33 includes a base portion 331, a contacting portion 332, a pushing portion 333 and an engaging portion 334. The contacting portion 332 is formed on a side of the base portion 331, and a protrusion 332*a* is formed on the contacting portion 332. The pushing portion 333 is formed on the other side of the base portion 331, and the pushing portion 333 includes a pushing surface 333*a* which is an inclined structure in this embodiment. The pushing surface 333*a* is not limited to the inclined structure and can be other structures, such as a curved structure on the other embodiment. The engaging portion 334 is extended from the pushing portion 333. As the locking block 33 is installed on the installing slot 228 of the second joint component 22, the pushing portion 333 passes through the hole and protrudes outside the second joint component 22. The pushing surface 333*a* inclines from top to bottom. The end of the resilient component 32 sheathes the protrusion 332*a*, and the resilient component 32 is disposed between the contacting portion 332 and the strip block 31. The engaging portion 334 is detachably engaged with the button assembly 23. Correspondingly, a locking slot 236 is formed on a side of the sliding block 231 of the button assembly 23, and the locking slot 236 is for engaging with the locking block 33. A shape of the locking slot 236 corresponds to a shape of the engaging portion 334. In this embodiment, the engaging portion 334 of the locking block 33 and the locking slot 236 are engaged by a mortise joint. Preferably, the mortise joint can be a dovetail joint.

As the supporting device 1 shown in FIG. 2 is extended completely, the button assembly 23 locks the pivotal movement of the first joint component 21 and the second joint component 22. That is, the button assembly 23 is at a locking position when the first joint component 21 and the second joint component 22 are locked. The engaging portion 334 is aligned to the locking slot 236. Then, as shown in FIG. 1, as the infant seat 2 is to be installed on the supporting device 1, the infant seat 2 contacts and pushes the pushing surface 333*a* to install on the two joint devices 20. Therefore, the locking block 33 is pushed to retracted into the second joint component 22, so that the engaging portion 334 is engaged into the locking slot 236, preventing the sliding block 231, from moving so as to prevent the supporting device 1 from being folded accidentally in a procedure of installing the infant seat 2 on the supporting device 1. As the infant seat 2 is detached from the supporting device 1, the resilient component 32 returns the locking block 33, so that the engaging portion 334 is separated from the locking slot 236, and the sliding block 231 is released. Therefore, a moving direction of the safety lock mechanism 30 is intersected with a sliding plane formed by the button assembly 23. That is, a sliding direction of the sliding block 231 is intersected with a sliding direction of the locking block 33. Preferably, the moving direction of the safety lock mechanism 30 is perpendicular to the sliding plane. That is, the sliding direction of the sliding block 231 is perpendicular to the sliding direction of the locking block 33.

As the supporting device 1 is in the partially extended state the locking slot 236 is not aligned to the engaging portion 334. Therefore as the infant seat 2 is desired to couple with the with the supporting device 1 and pushes the pushing surface 333*a*, the sliding block 231 is abutted against the engaging portion 334 to prevent the locking block 33 from retracting into the second joint component 22. Hence, the infant seat 2 cannot be coupled with the supporting device 1 in this situation, so as to ensure the operating safety of the infant seat 2.

Figure 12:
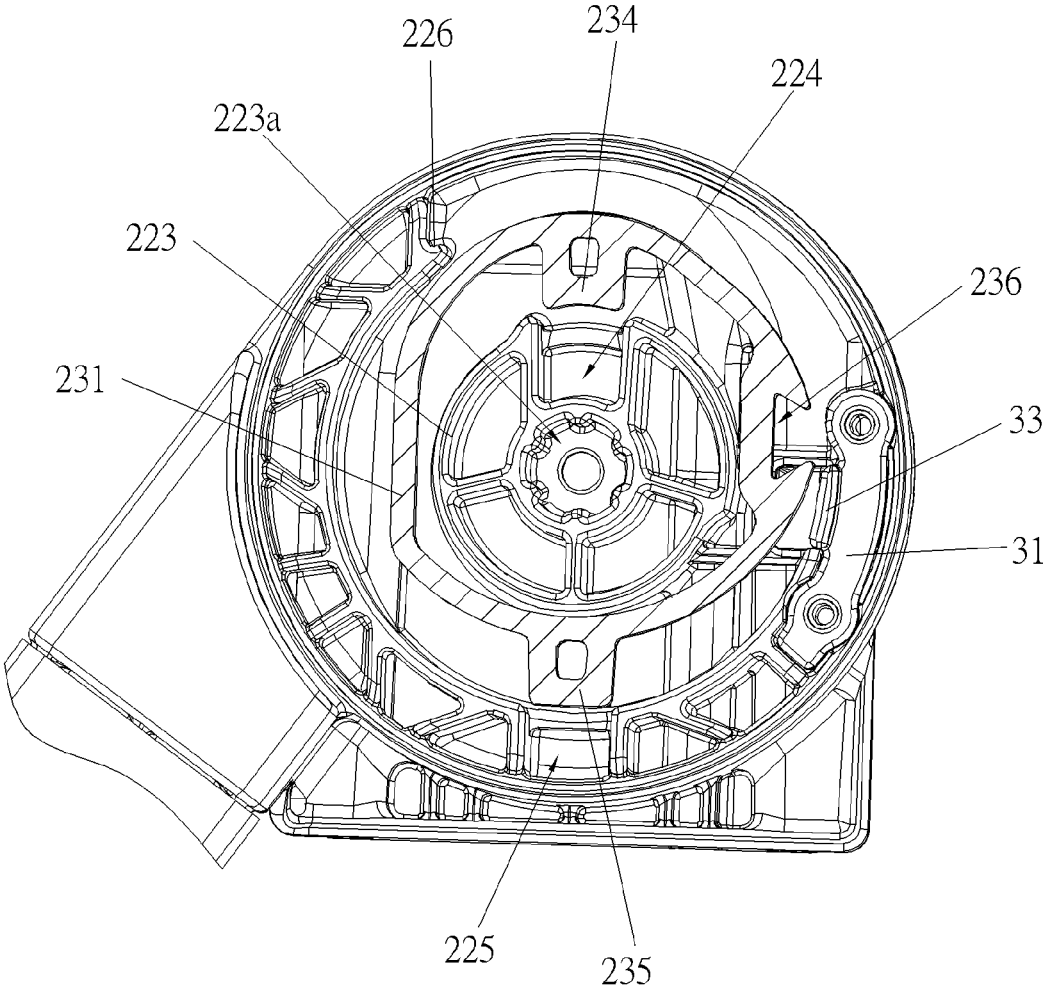
FIG. 12 is a sectional view illustrating that safety lock mechanism is disengaged from and abuts against the button assembly as the supporting device is in an extended state and the joint device is in a released state according to the embodiment of the present invention.
Figure 13:
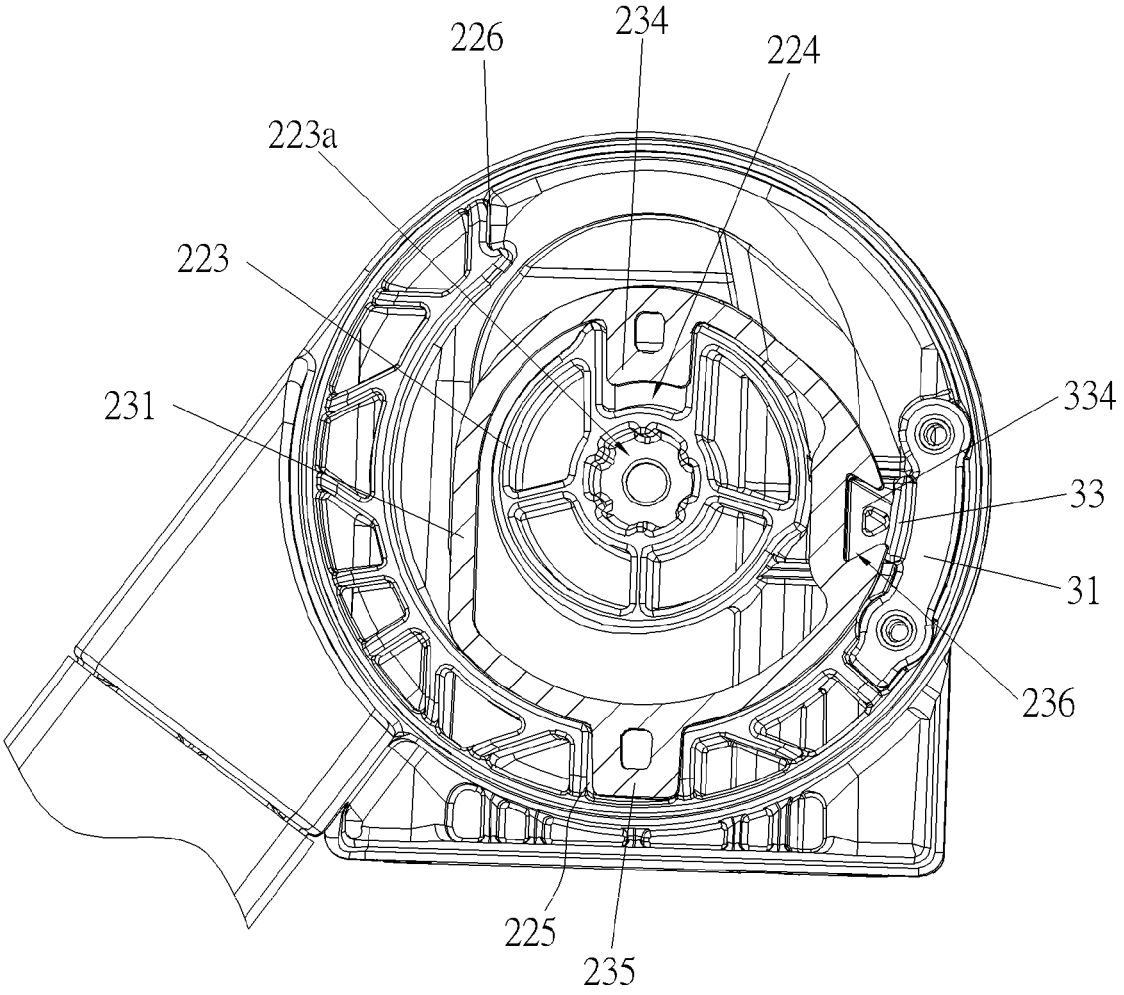
FIG. 13 is a sectional view illustrating that safety lock mechanism is engaged with the button assembly as the supporting device is in the extended state and the joint device is in a locking state according to the embodiment of the present invention.
Figure 14:
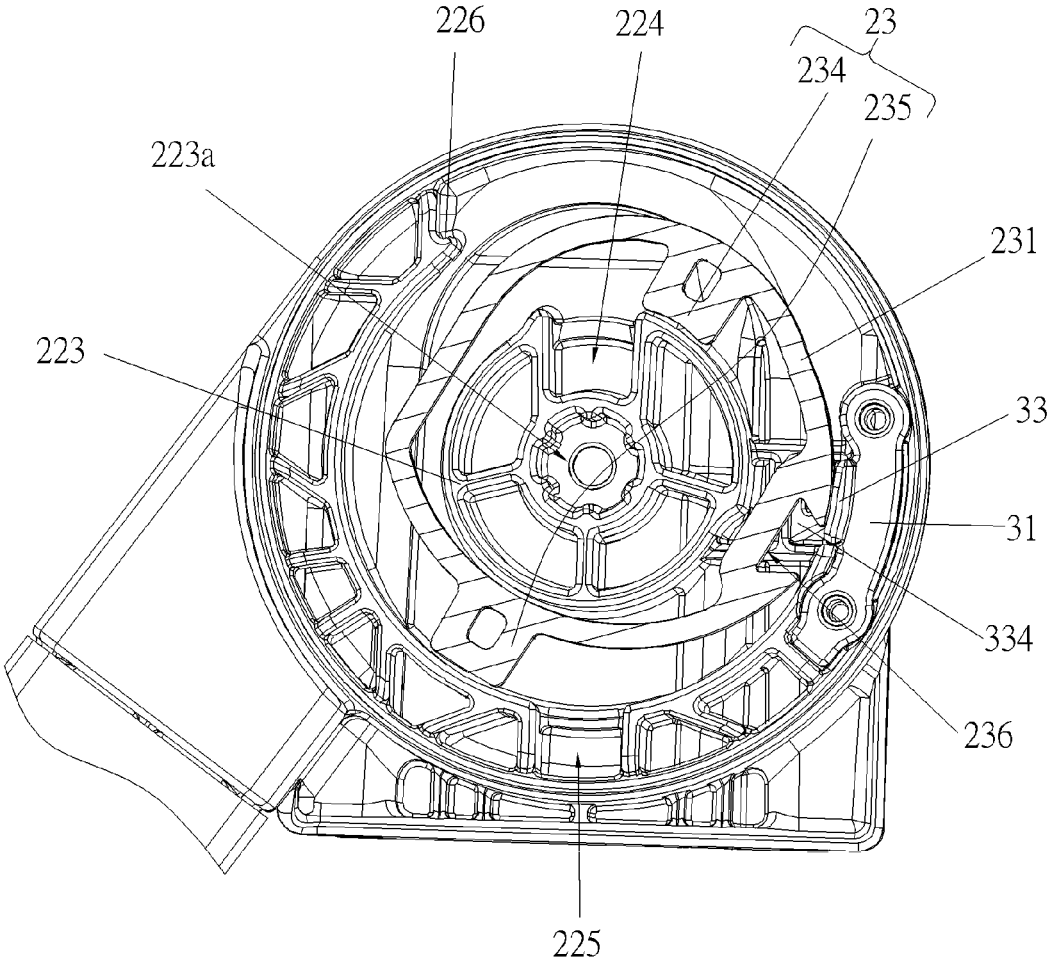
FIG. 14 is a sectional view illustrating that safety lock mechanism is disengaged from and abuts against the button assembly as the supporting device is in a partially extended state and the joint device is in the released state according to the embodiment of the present invention.
Figure 15:
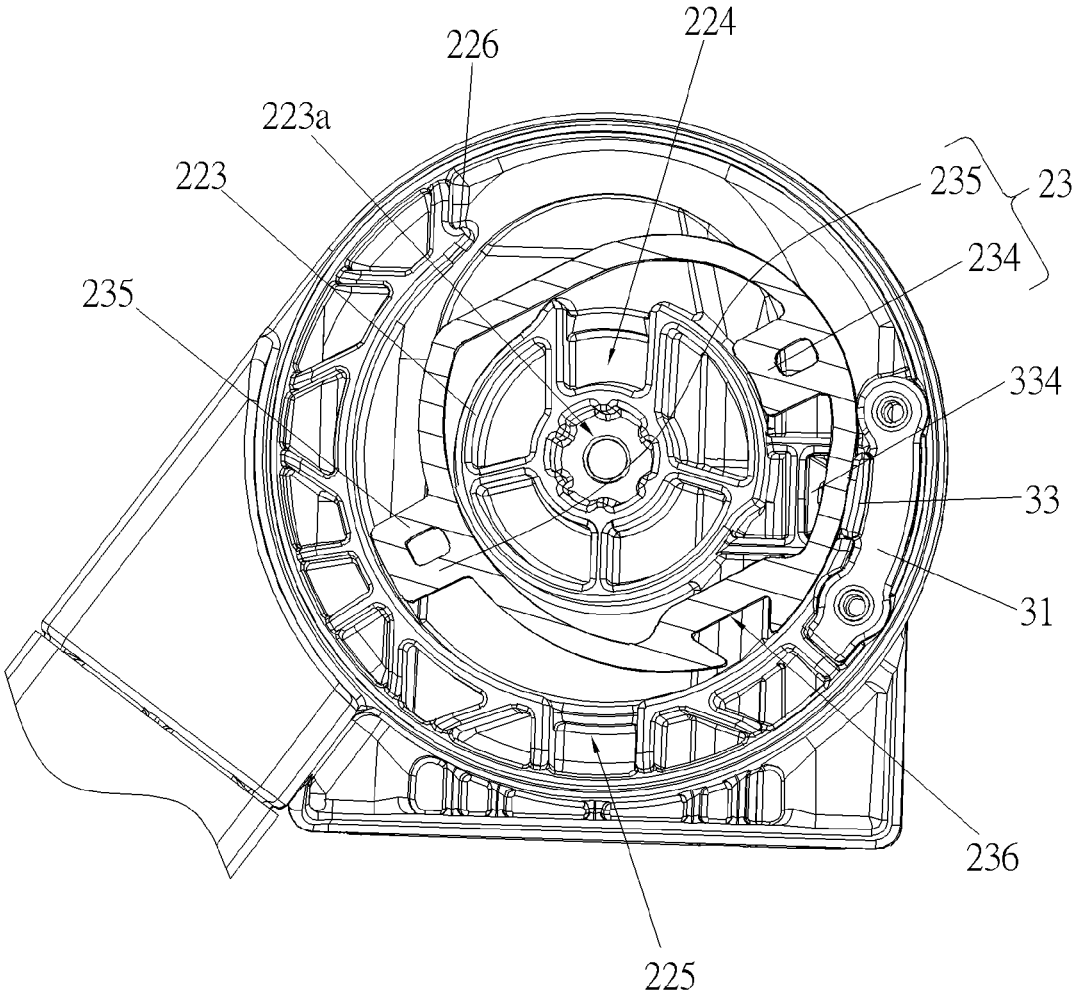
FIG. 15 is a sectional view illustrating that safety lock mechanism is disengaged from and abuts against the button assembly as the supporting device is a folded state and the joint device is in the released state according to the embodiment of the present invention.

Operational principle and procedure of the supporting device 1 are described with FIG. 1 to FIG. 15. FIG. 12 is a sectional view illustrating that safety lock mechanism 30 is disengaged from and abuts against the button assembly 23 as the supporting device 1 is in the extended state and the joint device 20 is in a released state according to the embodiment of the present invention. FIG. 13 is a sectional view illustrating that safety lock mechanism 30 is engaged with the button assembly 23 as the supporting device 1 is in the extended state and the joint device 20 is in a locking state according to the embodiment of the present invention. FIG. 14 is a sectional view illustrating that safety lock mechanism 30 is disengaged from and abuts against the button assembly 23 as the supporting device 1 is in a partially extended state and the joint device 20 is in the released state according to the embodiment of the present invention. FIG. 15 is a sectional view illustrating that safety lock mechanism 30 is disengaged from and abuts against the button assembly 23 as the supporting device 1 is a folded state and the joint device 20 is in the released state according to the embodiment of the present invention.

As the supporting frame 10 is in the folded state or is not extended completely, the first protruding block 234 contacts against the side wall of the column 223, so that the button assembly 23 cannot return to the locking position. That is, the button assembly 23 is at a released position when the first joint component 21 and the second joint component 22 are free to move relative to each other. As shown in FIG. 14 and FIG. 15, the button assembly 23 releases the pivotal movement of the first joint device 21 and the second joint device 22. As the infant seat 2 is desired to be installed on the supporting device 1, the two first supporting components 11 and the two second supporting components 12 move away from each other, so that the supporting device 1 is moved toward the extended state. As the supporting device 1 is extended completely, as shown in FIG. 12, the first protruding block 234 of the button assembly 23 is aligned to the engaging slot 224 of the column 223, and the second protruding block 235 is aligned to the concave 225. At this time, the sliding block 231 is returned to the locking position by the recovering component 237, so that the first protruding block 234 of the button assembly 23 is engaged inside the engaging slot 224 of the column 223, and the second protruding block 235 is engaged inside the concave 225, so as to lock the joint device 20 by the button assembly 23, as shown in FIG. 13. The locking slot 236 of the sliding block 231 is aligned to the engaging portion 334 when the sliding block 231 is at the locking position As the infant seat 2 is installed on the supporting device 1, the infant seat 2 slides along and is engaged with the coupling portion 35 of the second joint component 22, therefore the infant seat 2 contacts and presses the pushing surface 333*a* of the locking block 33, so that the locking block 33 slides along the hole and retracts into the second joint component 22. Therefore, the engaging portion 334 of the locking block 33 is engaged into the locking slot 236 of the sliding block 231, so that the sliding block 231 cannot slide along the guiding way 213 to release the pivotal movement of the first joint device 21 and the second joint device 22, so as to prevent the supporting frame 10 from being folded accidentally when the infant seat 2 is coupled thereon. That is, only when the supporting device 1 is extended completely, the locking slot 236 of the sliding block 231 is aligned to the engaging portion 334, and the locking block 33 is able to retract into the second joint component 22, so that the infant seat 2 is able to engage with the supporting frame 10. On the contrary, if the supporting frame 10 is not extended completely, the locking slot 236 is not aligned to the engaging portion 334, so that the sliding block 231 abuts against the engaging portion 334 of the locking block 33. Therefore, the locking block 33 cannot retract into the second joint component 22, so as to prevent the infant seat 2 from engaging with the supporting frame 10. The first joint component 21 and the second joint component 22 of the joint device 20 are not locked by the button assembly 23 and can pivot relative to each other freely as the supporting device 1 is not unfolded completely. It is very dangerous to install the infant seat 2 on the supporting device 1 when the supporting device 1 is not extended completely, and the present invention provides the safety lock mechanism 30 to prevent this danger.

As the infant seat 2 is detached from the supporting device 1, the locking block 33 is returned by the resilient component 32 to protrude outside the second joint component 22 again, so that the engaging portion 334 is separated from the locking slot 236. As a result, the pressing portion 233 can be operated to press so that the sliding block 231 is able to slide along the guiding way 213, and then the first protruding block 234 and the second protruding block 235 are separated from the engaging slot 224 and the concave 225 respectively, so as to release the button assembly 23 to fold the supporting device 1 pivotally.

The engaging portion 334 of the locking block 33 of the safety lock mechanism 30 is detachably engaged with the button assembly 23. As the supporting device 1 is extended completely, the infant seat 2 pushes the locking block 33, so as to engage the engaging portion 334 with the button assembly 23 correspondingly. Therefore, the button assembly 23 cannot be released, so as to prevent the supporting device 1 from being folded accidentally in the procedure of installing the infant seat 2 on the supporting device 1. After detaching the infant seat 2 from the supporting device 1, the engaging portion 334 is separated from the button assembly 23, so that the button assembly 23 is released and can be operated to fold the supporting device 1. As the supporting device 1 is not extended completely, the locking block 33 contacts against the button assembly 23 and cannot move into the second joint component 22, so as to prevent the infant seat 2 from engaging with the supporting device 1, so as to ensure the operating safety of the infant seat 2. An operation of folding the supporting device 1 with the safety lock mechanism 30 of the present invention is simple.

In contrast to the prior art, the safety lock mechanism of the present invention can movably passes through the second joint component to engage with or detached from the button assembly, so as to lock or release the button assembly. Therefore, only when the supporting device is unfolded completely, the infant seat is able to install on the joint device, so as to prevent the supporting device from being folded accidentally in a procedure of installing the infant seat on the supporting device. In addition, as the supporting device is not unfolded completely, the infant seat is not able to install on the joint device, so as to increase the operating safety and to prevent an error operation of installation. After detaching the infant seat from the supporting device, the locking block is separated from the button assembly, so that the button assembly is released and the supporting device is able to be folded, so as to ensure the safety of operating the infant seat.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A locking assembly, comprising:

a joint device comprising:

a first joint component;

a second joint component pivoted to the first joint component; and a one-piece button assembly slidably disposed between the first joint component and the second joint component, the button assembly locking a pivotal movement between the first joint component and the second joint component, a locking slot being formed on the button assembly; and a safety lock mechanism movably passing through the second joint component to selectively contactably engage and separately disengage with the locking slot on the button assembly, so as to interfere with the button assembly and prevent the button assembly from moving selectively.

2. The locking assembly of claim 1, wherein an installing slot is formed on the second joint component, and the safety lock mechanism is movably disposed on the installing slot.

3. The locking assembly of claim 1, wherein a hole is formed on the second joint component, and the safety lock mechanism movably passes through the hole.

4. The locking assembly of claim 1, wherein a moving direction of the safety lock mechanism is intersected with a pivotal plane formed by the first joint component and the second joint component.

5. The locking assembly of claim 4, wherein the moving direction of the safety lock mechanism is perpendicular to the pivotal plane.

6. The locking assembly of claim 1, wherein a moving direction of the safety lock mechanism is intersected with a sliding plane formed by the button assembly.

7. The locking assembly of claim 6, wherein the moving direction of the safety lock mechanism is perpendicular to the sliding plane.

8. The locking assembly of claim 1, wherein the safety lock mechanism comprises a locking block movably passing through the second joint component.

9. The locking assembly of claim 8, wherein the safety lock mechanism further comprises a resilient component disposed between the locking block and the second joint component.

10. The locking assembly of claim 9, wherein the locking block comprises:

a base portion;

a contacting portion formed on a side of the base portion, the resilient component being disposed between the contacting portion and the second joint component;

a pushing portion formed on the other side of the base portion, the pushing portion being for movably passing through the second joint component; and an engaging portion formed on the pushing portion, the engaging portion being for detachably engaging with the button assembly.

11. The locking assembly of claim 8, wherein a portion of the locking block exposed outside the second joint component comprises an inclined surface or a curved surface.

12. The locking assembly of claim 8, wherein the locking slot is for engaging with the locking block.

13. The locking assembly of claim 12, wherein the locking block and the locking slot are engaged by a mortise joint.

14. A supporting device for supporting an infant seat, comprising:

a supporting frame;

a joint device disposed on one side of the supporting frame comprising:

a first joint component;

a second joint component pivoted to the first joint component; and a one-piece button assembly movably disposed between the first joint component and the second joint component, a locking slot being formed on the button assembly; and a safety lock mechanism movably disposed on the second joint component to selectively contactably engage and separately disengage with the locking slot on the button assembly, so as to interfere with the button assembly and prevent the button assembly from moving selectively.

15. The supporting device of claim 14, wherein the safety lock mechanism comprises a locking block retractably disposed on the second joint component.

16. The supporting device of claim 14, wherein the button assembly comprises a sliding block slidably disposed on the first joint component.

17. The supporting device of claim 16, wherein the sliding block comprises a protruding block to engage with the second joint when the supporting device is at an extended state.

18. The supporting device of claim 14, wherein the locking slot is for engaging with the locking block.

19. The supporting device of claim 14, wherein the supporting frame includes two first supporting frames and two second supporting frames, the supporting device includes two joint devices, and the two joint devices are disposed between the two first supporting frames and the two second supporting frames respectively.

20. A combination comprising an infant seat and a supporting device for detachably coupling with the infant seat, the supporting device including:

a supporting frame movable between an extended state and a folded state;

a joint device disposed on the supporting frame comprising a one-piece button assembly locking the joint device so as to retain the supporting frame being at the extended state; and a safety lock mechanism movably disposed on the joint device;

wherein the joint device includes a coupling portion to allow the infant seat to engage thereon, and when the infant seat is coupling with the joint device, the infant seat presses the safety lock mechanism to contactably engage with the coupling portion, so as to prevent the supporting device from being folded accidentally.

21. The combination of claim 20, wherein the joint device includes a first joint component, a second joint component pivoted to the first joint component and the button assembly movable disposed between the first joint component and the second joint component, and the safety lock mechanism comprises a locking block retractably disposed on the second joint component.

22. A combination comprising an infant seat and a supporting device for detachably coupling with the infant seat, the supporting device including:

a supporting frame being movable between an extended state and a folded state;

a joint device disposed on the supporting frame comprising a first joint component, a second joint component pivoted to the first joint component and a one-piece button assembly disposed between the first joint component and the second joint component, the button assembly being movable between a locking position when the first joint component and the second joint component are locked and a released position when the first joint component and the second joint component are free to move relative to each other; and a safety lock mechanism movably disposed on the second joint comprising a locking block retractably disposed on the second joint component;

wherein when the button assembly is at the released position, the first joint component and the second joint component are pivoted relative to each other, and the button assembly is contactably abutted against the locking block so that the locking block cannot retract into the second joint component, so as to prevent the infant seat from coupling with the supporting device.

* * * * *